US009434492B1

(12) United States Patent
Russell et al.

(10) Patent No.: US 9,434,492 B1
(45) Date of Patent: Sep. 6, 2016

(54) METHOD OF FILLING A PLURALITY OF BOTTOM GUSSETED POUCHES DISPOSED ON A ROLL

(71) Applicants: James Russell, Shortsville, NY (US); John Ferber, Clifton Springs, NY (US)

(72) Inventors: James Russell, Shortsville, NY (US); John Ferber, Clifton Springs, NY (US)

( * ) Notice: Subject to any disclaimer, the term of this patent is extended or adjusted under 35 U.S.C. 154(b) by 0 days.

(21) Appl. No.: 14/800,222

(22) Filed: Jul. 15, 2015

Related U.S. Application Data

(60) Continuation-in-part of application No. 14/733,205, filed on Jun. 8, 2015, which is a division of application No. 14/467,138, filed on Aug. 25, 2014, now Pat. No. 9,050,770.

(51) Int. Cl.
*B65B 43/12* (2006.01)
*B65B 43/36* (2006.01)

(52) U.S. Cl.
CPC ..... *B65B 43/123* (2013.01); *B65B 43/36* (2013.01)

(58) Field of Classification Search
CPC ... B65B 43/123; B65B 43/36; B65B 43/465; B65B 43/30; B65B 9/13
USPC ..... 53/459
See application file for complete search history.

(56) References Cited

U.S. PATENT DOCUMENTS 2,154,521 A 4/1939 Maxfield
3,051,103 A 8/1962 Williams
3,203,323 A 8/1965 Adams et al.
3,482,763 A * 12/1969 Carrigan ..... B31B 41/00 229/69
3,929,275 A * 12/1975 Bolling ..... B31B 37/00 383/111
4,171,048 A 10/1979 Ernst
4,285,681 A 8/1981 Walitalo et al.
4,491,959 A 1/1985 Loefberg
4,500,307 A 2/1985 Bridgeman
4,561,107 A 12/1985 Herder
4,816,104 A 3/1989 Benoit
4,844,956 A * 7/1989 Galimberti ..... B65D 31/147 383/37
4,913,693 A * 4/1990 Ball ..... B65D 75/563 493/194
4,997,504 A * 3/1991 Wood ..... B29C 65/1403 156/204
5,087,234 A * 2/1992 Prader ..... B31B 1/00 206/554
5,118,202 A * 6/1992 Bruno ..... B65B 43/123 383/203
5,313,766 A * 5/1994 Rimondi ..... B29C 65/229 53/245

(Continued)

OTHER PUBLICATIONS

Tawfik, Sameh, "First Action Interview Office Action Summary," issued for U.S. Appl. No. 14/854,697, filed Sep. 15, 2015, mailed on Mar. 29, 2016, Alexandria, VA.

(Continued)

*Primary Examiner* — Sameh Tawfik
(74) *Attorney, Agent, or Firm* — Woods Oviatt Gilman LLP; Dennis B. Danella, Esq.

(57) ABSTRACT

A method of filling a plurality of bottom gusseted pouches disposed on a roll in a top-to-bottom end orientation is provided. The method comprises unwinding the respective bottom gusseted pouch from the roll; providing access to an interior compartment defined by front and back panels and the bottom gusseted end of the respective bottom gusseted pouch; filling the interior compartment with at least one item to produce a filled pouch; and cutting the respective bottom gusseted pouch from the roll by cutting between the top end of the respective bottom gusseted pouch and the bottom gusseted end of an adjacent bottom gussetted pouch connected to the respective bottom gusseted pouch.

27 Claims, 10 Drawing Sheets

(56) References Cited

U.S. PATENT DOCUMENTS

| | | | | |
|---|---|---|---|---|
| 5,816,018 | A * | 10/1998 | Bois | B65B 61/188 493/213 |
| 6,017,412 | A | 1/2000 | Van Erden et al. | |
| 6,068,585 | A * | 5/2000 | Ouchi | B31B 19/90 493/194 |
| RE36,759 | E * | 7/2000 | Hoover | B31D 5/0073 156/147 |
| 6,135,281 | A | 10/2000 | Simahaee | |
| 6,293,896 | B1 | 9/2001 | Buchman | |
| 6,416,452 | B1 | 7/2002 | Meyer | |
| 6,422,753 | B1 * | 7/2002 | Thomas | B65D 31/12 383/209 |
| 6,423,356 | B2 | 7/2002 | Richison et al. | |
| 6,425,847 | B1 * | 7/2002 | Broenstrup | B31B 37/00 493/186 |
| 6,477,820 | B1 * | 11/2002 | Dutra | B31B 19/90 53/412 |
| 6,517,660 | B2 * | 2/2003 | Ausnit | B31B 19/90 156/269 |
| 6,588,176 | B1 | 7/2003 | Buchman | |
| 6,591,586 | B1 * | 7/2003 | Pape | B65B 43/123 53/381.2 |
| 6,634,158 | B1 | 10/2003 | Bois | |
| 6,740,020 | B2 | 5/2004 | Horibe et al. | |
| 6,796,932 | B2 | 9/2004 | Kuge et al. | |
| 6,807,794 | B2 | 10/2004 | Ausnit et al. | |
| 6,827,490 | B2 * | 12/2004 | Baker | B65D 33/002 383/37 |
| 6,942,608 | B2 | 9/2005 | Linton et al. | |
| 6,986,237 | B2 | 1/2006 | Ausnit et al. | |
| 7,093,978 | B2 | 8/2006 | Tan | |
| 7,114,309 | B2 | 10/2006 | Ausnit | |
| 7,285,083 | B2 | 10/2007 | Merken-Schiller et al. | |
| 7,325,378 | B2 | 2/2008 | Ausnit | |
| 7,331,917 | B2 | 2/2008 | Totani | |
| 7,490,451 | B2 | 2/2009 | Matthews | |
| 8,167,487 | B2 * | 5/2012 | Fuller | B31B 19/90 383/120 |
| 8,414,465 | B2 | 4/2013 | Totani | |
| 8,579,780 | B2 | 11/2013 | Senbo | |
| 9,028,386 | B2 | 5/2015 | Fraser et al. | |
| 2005/0084184 | A1 | 4/2005 | Withers | |
| 2006/0115187 | A1 | 6/2006 | Ausnit et al. | |
| 2006/0194684 | A1 | 8/2006 | Tan | |
| 2008/0092487 | A1 | 4/2008 | Ausnit | |
| 2012/0085479 | A1 | 4/2012 | Goto | |

OTHER PUBLICATIONS

Tawfik, Sameh, "First Action Interview Pilot Program Pre-Interview Communication," issued for U.S. Appl. No. 14/854,697, filed Sep. 15, 2015, mailed on Jan. 22, 2016, Alexandria, VA.

Tawfik, Sameh, "First Action Interview Office Action Summary," issued for U.S. Appl. No. 14/733,205, filed Jun. 8, 2015, mailed on Feb. 8, 2016, Alexandria, VA.

Tawfik, Sameh, "First Action Interview Pilot Program Pre-Interview Communication," issued for U.S. Appl. No. 14/733,205, filed Jun. 8, 2015, mailed on Nov. 12, 2015, Alexandria, VA.

Tawfik, Sameh, "First Action Interview Pilot Program Pre-Interview Communication," issued for U.S. Appl. No. 14/733,205, filed Jun. 8, 2015, mailed on Sep. 2, 2015, Alexandria, VA.

* cited by examiner

METHOD OF FILLING A PLURALITY OF BOTTOM GUSSETED POUCHES DISPOSED ON A ROLL

CROSS-REFERENCE TO RELATED APPLICATIONS

This application is a continuation-in-part of U.S. patent application Ser. No. 14/733,205, filed on Jun. 8, 2015, which is a divisional of U.S. patent application Ser. No. 14/467,138, now U.S. Pat. No. 9,050,770, filed on Aug. 25, 2014, the contents of which are hereby incorporated by reference in their entirety.

FIELD OF THE INVENTION

The present invention is directed to a method of filling a plurality of bottom gusseted pouches disposed on a roll, wherein each of the pouches may be formed at least in part of a multilayered supported film, and more particularly, a method of filling a plurality of bottom gusseted pouches wound onto a roll in a top-to-bottom end orientation.

BACKGROUND OF THE INVENTION

It is well known to use different types of pouches to serve as a container or packaging for many different types of consumer products, as well as food and beverage products. One type of pouch that is used for these types of products is referred to as a bottom gusseted pouch, wherein the bottom portion of the pouch includes a gusset that allows for the bottom to expand outwardly to provide additional storage spaced within the pouch. Further, when the bottom gusseted pouch is formed of a structured film, the pouch is capable of standing upright on a support surface.

A bottom gusseted pouch typically includes a top end, a bottom end, and opposing side edges that are connected with one another to define an interior compartment spaced therein. This type of pouch is typically manufactured in a side-by-side orientation so that the sides of each of the pouches are connected in series. In some cases, the flow of the web material used to form the front and back panels of the pouch is perpendicular to the longitudinal axis of the individual pouches. Further, the top end includes a zipper that allows the pouch to be selectively opened and closed to allow items to be placed within the interior compartment space. As previously mentioned, the bottom end includes a gusset that allows for expansion of the bottom portion of the pouch, which allows the finished pouch to remain in an upright position.

One significant problem with the side-to-side manufacturing orientation of the bottom gusseted pouches is that, after the pouches are manufactured, but not yet separated from one another, they cannot easily be rolled into a uniform cylindrical roll. In particular, such a roll would be non-uniform due to the increased amount of material used to form the bottom gusset at the bottom end of the pouch, as well as the zipper located at the top end of the pouch. The roll would have significant non-uniformities, such as bumps, that would make it difficult for a downstream packaging operation to use the roll in a subsequent filling process. Furthermore, the side-to-side manufacturing process requires that the pouches be opened, which creates a problem when the downstream filling process requires that the inside of the pouch be sterile. Also, side-to-side pouch manufacturing processes requires a significant amount of floor space in a manufacturing facility, which can be problematic in some instances.

As such, there is a need for a method for producing a roll of serially connected bottom gusseted pouches formed of structured film having a top- to-bottom end orientation to provide a compact cylindrical roll of completed bottom gusseted pouches. The present invention addresses this and other needs.

BRIEF SUMMARY OF THE INVENTION

One aspect of the present invention is directed to a method of manufacturing a roll of a plurality of bottom gusseted pouches with each respective pouch having a bottom gusseted end, a re-sealable top end and sealed first and second side edges. The plurality of pouches are serially connected in a top-to-bottom end orientation. The method comprises unwinding at least one pouch webbing in a first flow direction with the at least one pouch webbing defining front and back panels of a respective pouch. A gusset webbing is inserted between the front and back panels in a second flow direction which is transverse to the first flow direction. The gusset webbing is attached to the front and back panels to form the bottom gusseted end of the respective pouch. A closure mechanism is inserted between the front and back panels in a third flow direction which is transverse to the first flow direction. The closure mechanism may be attached to one or both of the front and back panels to form the resealable top end of the respective pouch. The gusset webbing and the closure mechanism are in spaced parallel relation. The closure mechanism is attached to one or both of the front and back panels to form the re-sealable top end of the respective pouch. The side edges of the front and back panels are sealed to complete the respective pouch. The completed respective pouch is wound onto the roll in the first flow direction and the steps are then repeated to form the other bottom gusseted pouches on the roll. The at least one of the pouch webbing and the gusset webbing is formed of a supported film, wherein the supported film includes at least a first film layer and a second film layer.

A further aspect of the present invention is directed to a method of manufacturing a bottom gusseted pouch having a bottom gusseted end, a top end having a fitment, and sealed first and second side edges. The method comprises unwinding at least one pouch webbing in a first flow direction. The at least one pouch webbing forms front and back panels of the bottom gusseted pouch. A gusset webbing is inserted between the front and back panels in a second flow direction which is transverse to the first flow direction. The gusset webbing is attached to the front and back panels to form the bottom gusseted end of the pouch. The side edges of the front and back panels are sealed such that the sealed side edges and bottom gusseted end define a pouch compartment. At least a portion of the fitment is positioned between the front and back panels adjacent to the top end of the pouch. The fitment is then sealed to the front and back panels of the pouch to provide selective access to the pouch compartment. At least one of the pouch webbing and the gusset webbing is formed of a supported film, wherein the supported film includes at least a first film layer and a second film layer.

A still further aspect of the present invention is directed to a method of filling a respective bottom gusseted pouch on a roll of bottom gusseted pouches. The respective bottom gusseted pouch includes front and back panels, a bottom gusset, a top end, and sealed first and second side edges. One or more of the front panel, back panel and bottom gusset is a supported film including first and second film layers, wherein the first film layer has a lower heat index that the second film layer. The method comprises unwinding the respective bottom gusseted pouch from the roll of bottom gusseted pouches. Access is provided to an interior compartment of the respective bottom gusseted pouch, which is defined by the front and back panels and the bottom gusseted end of the respective bottom gusseted pouch. The interior compartment is then filled with at least one item so as to produce a filled pouch. The respective bottom gusseted pouch is cut from the roll of bottom gusseted pouches by cutting between the top end of the filled pouch and a bottom gusset of a next succeeding pouch, either before or after the interior compartment is filled with the at least one item.

Additional objects, advantages and novel features of the present invention will be set forth in part in the description which follows, and will in part become apparent to those in the practice of the invention, when considered with the attached figures.

BRIEF DESCRIPTION OF THE DRAWINGS

The accompanying drawings form a part of this specification and are to be read in conjunction therewith, wherein like reference numerals are employed to indicate like parts in the various views, and wherein.

DETAILED DESCRIPTION OF THE INVENTION

Figure 1:
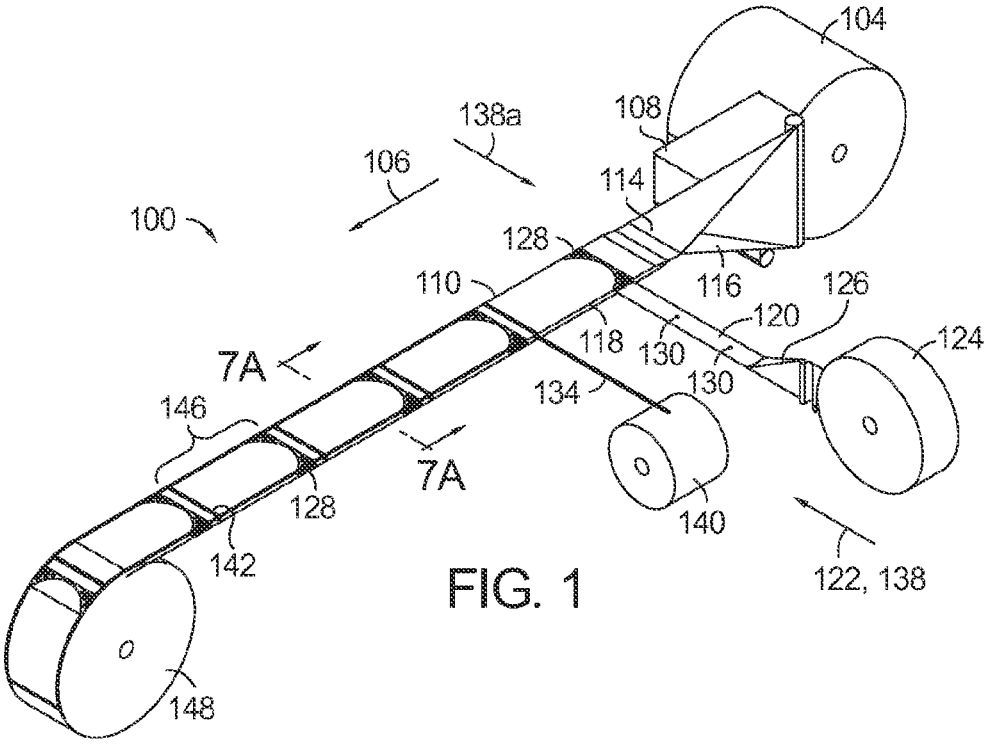
FIG. 1 is a perspective schematic view of a method for manufacturing a roll of a plurality of bottom gusseted pouches according to one embodiment of the present invention.
Figure 2A:
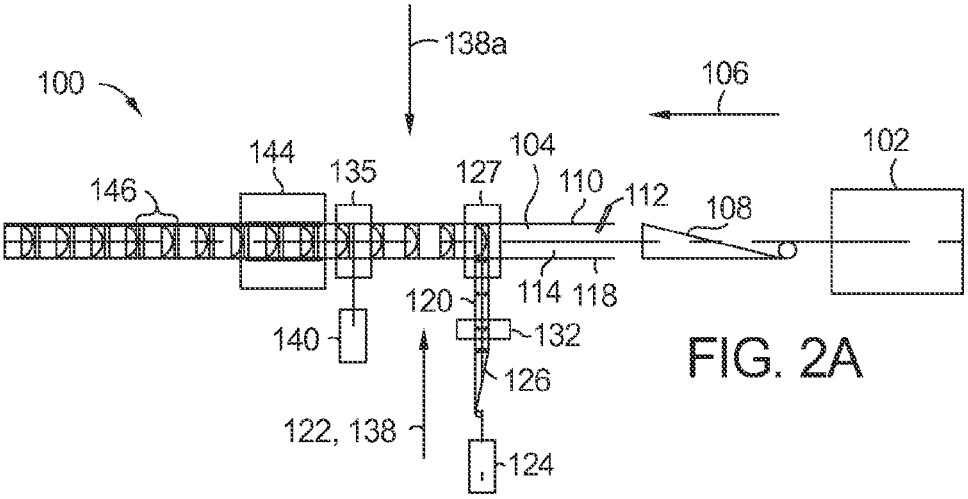
FIG. 2A is a top schematic view of the method shown in FIG. 1.
Figure 2B:
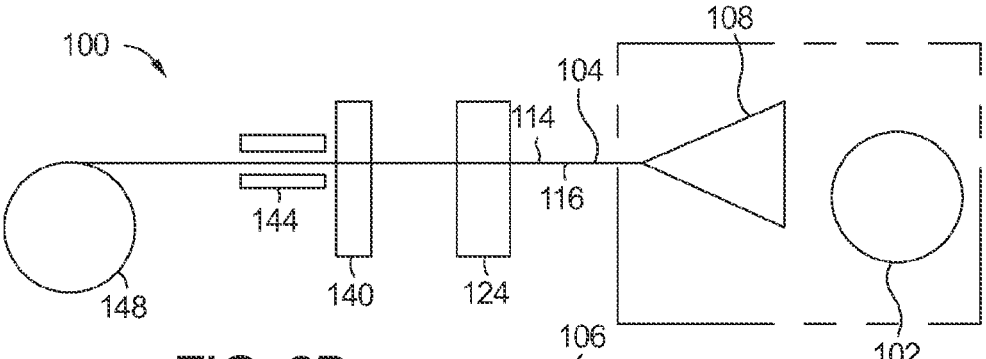
FIG. 2B is a side schematic view of the method shown in FIG. 1.

Referring to the drawings in detail, and specifically to FIGS. 1, 2A and 2B, reference numeral 100 generally designates a method of manufacturing a roll of a plurality of bottom gusseted pouches in accordance with one aspect of the present invention. By forming the bottom gusseted pouches from a structured film in a top-to-bottom orientation in accordance with the present invention, the plurality of completed bottom gusseted pouches can be wound into a cylindrical roll, which allows the pouches to be stored, transported and filled in an efficient manner.

To initiate method 100, a single roll 102 of pouch webbing 104 is unwound in a first flow direction 106 and folded within a webbing folder 108 to form a folded pouch webbing. In accordance with one embodiment of the present invention, pouch webbing 104 is folded in a direction that is parallel to, or along, a longitudinal axis of pouch webbing 104 to form a seam along an edge 110. The pouch webbing 104 is then sliced along the seam using a seam slitter 112 (see FIG. 2A) to form a front panel 114 and a back panel 116, each having aligned edges 110 and 118.

With front panel 114 and back panel 116 formed and positioned on top of one another, a bottom gusset webbing 120 may be inserted between front and back panels 114, 116 in a second flow direction 122 which is transverse to first flow direction 106 of pouch webbing 104. Prior to inserting gusset webbing 120 between front and back panels 114, 116, gusset webbing 120 is drawn from a gusset webbing roll 124 in second flow direction 122 and may be folded in a direction that is parallel to, or along, its longitudinal axis by a gusset folder 126. The folded gusset webbing 120 allows for the expansion of a bottom end of a completed pouch upon filling, and also provides a wider base such that the completed pouch can freely stand upon its gusseted end. After the desired length of gusset webbing 120 has been inserted between front and back panels 114, 116, gusset webbing 120 is then cut from gusset roll 124. The inserted gusset webbing 120 is then sealed to an inner surface of each of front panel 114 and back panel 116 using a heat sealer 127 to form a heat seal 128 at a bottom end of gusseted pouch. While gusset webbing 120 is described above as being cut before being sealed to front and back panels 114, 116, it is also within the scope of the invention to seal gusset webbing 120 to front and back panels 114, 116 prior to being cut from gusset roll 124. Furthermore, gusset webbing 120 may further have one or more gusset holes 130 defined therein by a gusset punch 132 (see FIG. 2A) prior to gusset webbing 120 being inserted between front and back panels 114, 116. Gusset holes 130 assist in sealing the gusset webbing 120 to front and back panels 114, 116 by allowing front and back panels 114, 116 to be heat sealed directly to one another through gusset holes 130 in order to maintain the position of gusset webbing 120 relative to front and back panels 114, 116.

A top end of a respective bottom gusseted pouch may include a closure mechanism 134 to allow selective access to an interior compartment 136 (FIGS. 7A, 7B) of the pouch to allow for the pouch to be filled and to allow a user to remove items contained within interior compartment 136. It should be understood that any suitable closure mechanism may be employed, including, but not limited to, a zipper mechanism, an adhesive, mating hook-and-loop materials, a slider mechanism, and rib-and-groove fasteners. Closure mechanism 134 is inserted between panels 114, 116 in a third flow direction 138 which is transverse to first flow direction 106 of pouch webbing 104. In accordance with one aspect of the present invention, second flow direction 122 (i.e., the flow direction of gusset webbing 120) may be the same as third flow direction 138 of closure mechanism 134 such that gusset webbing 120 and closure mechanism 134 are inserted from the same side of pouch webbing 104. Alternatively, second flow direction 122 may be opposite that of third flow direction 138*a* such that gusset webbing 120 is inserted from one side of pouch webbing 104 while closure mechanism 134 is inserted from the opposite side of pouch webbing 104.

In accordance with one aspect of the present invention, closure mechanism 134 is continually supplied by unwinding a closure roll 140 and closure mechanism 134 is inserted between front and back panels 114, 116. After the desired length of the closure mechanism 134 has been inserted between front and back panels 114, 116, closure mechanism 134 is then cut from closure roll 140 and sealed to the inner surface of one or both of front panel 114 and back panel 116 by mechanism 135 to form a resealable top end 142 of the bottom gusseted pouch. While closure mechanism 134 is described above as being cut before being sealed, it is also within the scope of the present invention that closure mechanism 134 may be sealed to one or both of front and back panels 114, 116 prior to being cut from closure roll 140. Further, closure mechanism 134 may be inserted between front and back panels 114, 116 at the same time that the gusset webbing 120 is being inserted between front and back panels 114, 116. Alternatively, closure mechanism 134 and gusset webbing 120 may be inserted in serial fashion with insertion of either the closure mechanism 134 or gusset webbing 120 sequentially following the insertion of the other.

Once gusset webbing 120 and closure mechanism 134 have been inserted and sealed to one or both of front and back panels 114, 116, an in-line sealer 144 operates to heat seal the side edges 110, 118 of front panel 114 and back panel 116 to form a completed respective bottom gusseted pouch 146 that remains connected to adjacent completed respective bottom gusseted pouches in a top-to-bottom end orientation. The completed bottom gusseted pouches 146 are then wound to form a finished cylindrical roll 148 for use in a subsequent filling process, such as the filling process that will be described below with reference to FIGS. 8-10.

It should be noted that the entire method of manufacturing the bottom gusseted pouches is conducted while pouch webbing 104 is under tension, including when the heat seal is applied to seal the side edges 110, 118 of front and back panels 114, 116, and to seal the gusset webbing 120 to front and back panels 114, 116 to form the bottom end of pouch 146. While any suitable amount of tension may be applied to pouch webbing 104 during production, in accordance with an aspect of the present invention, manufacturing method 100 proceeds wherein pouch webbing 104 is under a web tension of between about 1 N/m to about 20 kN/m, and more particularly between about 45 N/m to about 10 kN/m, and in a preferred embodiment between about 75 N/m to about 1 kN/m. While specific ranges have been provided, it should be understood that any desired amount of tension may be used, with such amount of tension determined based at least in part on the type and thickness of the pouch webbing materials being used, the number and thickness of any laminate layers within the pouch webbing material and the desired seal characteristics of the completed pouches. Such additional amounts of tension should be considered within the scope of the present invention.

Figure 3:
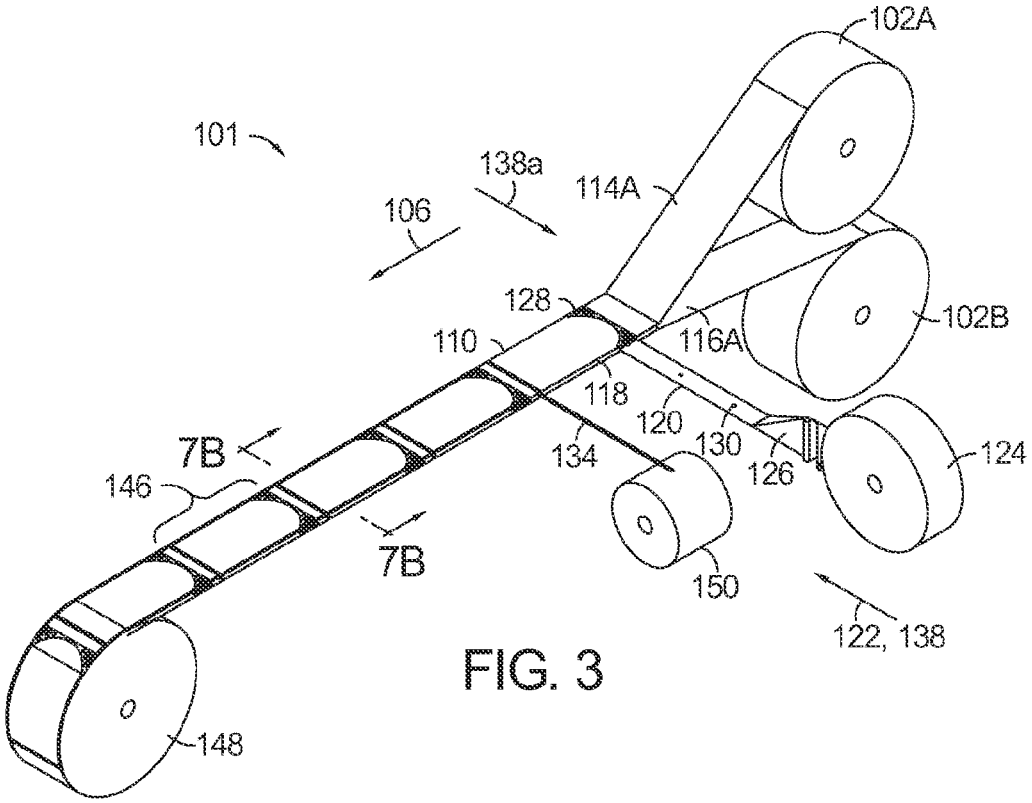
FIG. 3 is an alternative embodiment of a method for manufacturing a roll of a plurality of bottom gusseted pouches in accordance with the present invention.
Figure 4:
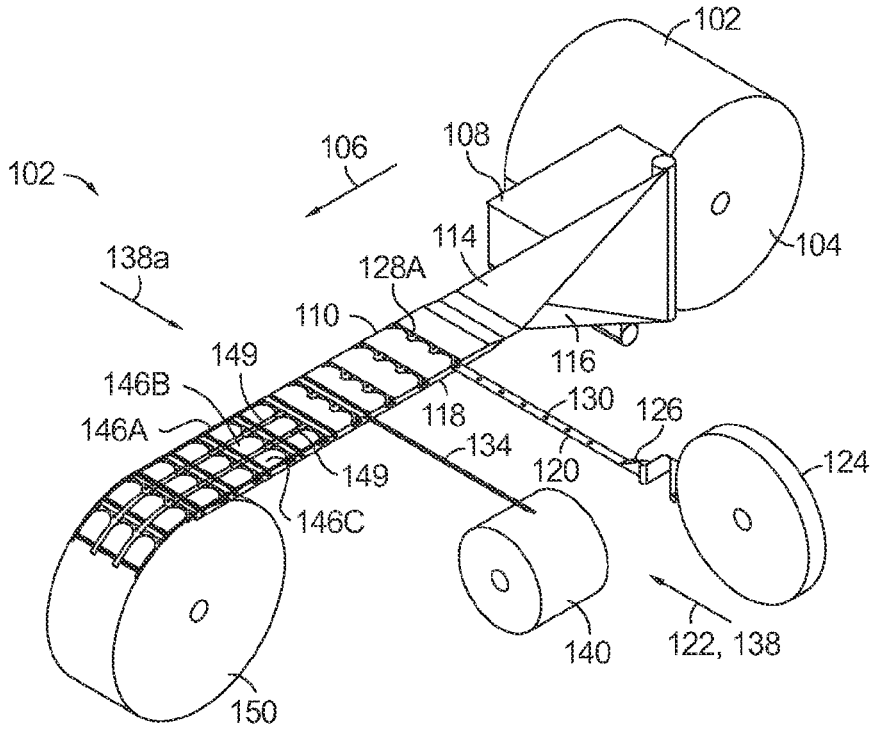
FIG. 4 is a further alternative embodiment of a method for manufacturing a roll of a plurality of bottom gusseted pouches in accordance with the present invention showing the manufacture of a plurality of side-by-side connected pouches within the roll.

Alternative embodiments of a method of manufacturing a roll of a plurality of bottom gusseted pouches in accordance with present invention are shown in FIGS. 3 and 4. Alternative manufacturing method 101, shown in FIG. 3, is similar to method 100 shown in FIGS. 1, 2A and 2B except for how the pouch webbing material is provided. As described above with regard to method 100, pouch webbing 104 is a single sheet webbing that is folded by webbing folder 108 and slit by seam slitter 112 to form front panel 114 and back panel 116. In the alternative embodiment shown in FIG. 3, front panel 114A and back panel 116A are constructed from separate pouch webbing rolls 102A, 102B, respectively. In accordance with one aspect of the invention, pouch webbing rolls 102A and 102B are arranged such that unwinding of rolls 102A, 102B in first flow direction 106 places the webbing material of front panel 114A on top of and in spaced parallel relation with the webbing material of back panel 116A such that opposing edges 110, 118 may be aligned. In this manner, the remainder of the method as described above with regard to method 100 may be employed. That is, the gusset webbing 120 may be inserted, sealed and cut, closure mechanism 134 may be inserted, sealed and cut, the side edges 110, 118 may be sealed, and the resultant finished pouches 146 may be wound onto roll 148 for filling. As webbing rolls 102A, 102B are independent from one another with each roll 102A, 102B forming its respective panel 114A, 116A, it should be understood that front panel 114A may be constructed of a different material that back panel 116A. In accordance with an aspect of the invention, one or both sides of either or both panels 114A, 116A may include printed matter. Front and back panels 114A, 116A may also be adjusted to obtain front-to-back print registration.

Turning now to FIG. 4, another manufacturing method 103 is provided. Most aspects of method 103 are similar to method 100 as described above with regard to FIGS. 1, 2A and 2B except for the aspect of sealing gusset webbing 120 between front and back panels 114, 116 and forming one or more heat seals between, and parallel to, side edges 110,118 to form pouches connected in a side-by-side orientation within the roll of pouches. As shown in FIG. 4, bottom gusset webbing 120 is sealed 128A between front and back panels 114, 116 in a scalloped pattern wherein open ends of the scallop identify the locations of the side walls of respective lateral pouches within the pouch webbing sheet material. Gusset webbing 120 may include a plurality of gusset holes 130, wherein each hole 130 is positioned to coincide with the open ends of the scalloped seal 128A to enable sealing of front panel 114 to back panel 116 though each gusset hole 130.

Following insertion, sealing and cutting of closure mechanism 134, in-line sealer 144 (such as that shown in FIGS. 2A and 2B) is adapted to seal side edges 110, 118 while also creating one or more heat seals 149 parallel to side edges 110, 118, wherein the internal heat seal coincides with the open ends of scalloped gusset webbing seal 128A. In this manner, a plurality of laterally connected pouches (e.g., pouches 146A, 146B, 146C) may be manufactured and sealed before being wound onto completed pouch roll 150. It should be noted that, while shown and described as employing a single sheet pouch webbing roll 102 and webbing folder 108 to produce front panel 114 and back panel 116, it is within the scope of the present invention that manufacturing method 103 may utilize an independent front panel pouch webbing roll and back panel pouch webbing roll similar to those shown and described above with regard to FIG. 3 and manufacturing method 101.

Figure 5:
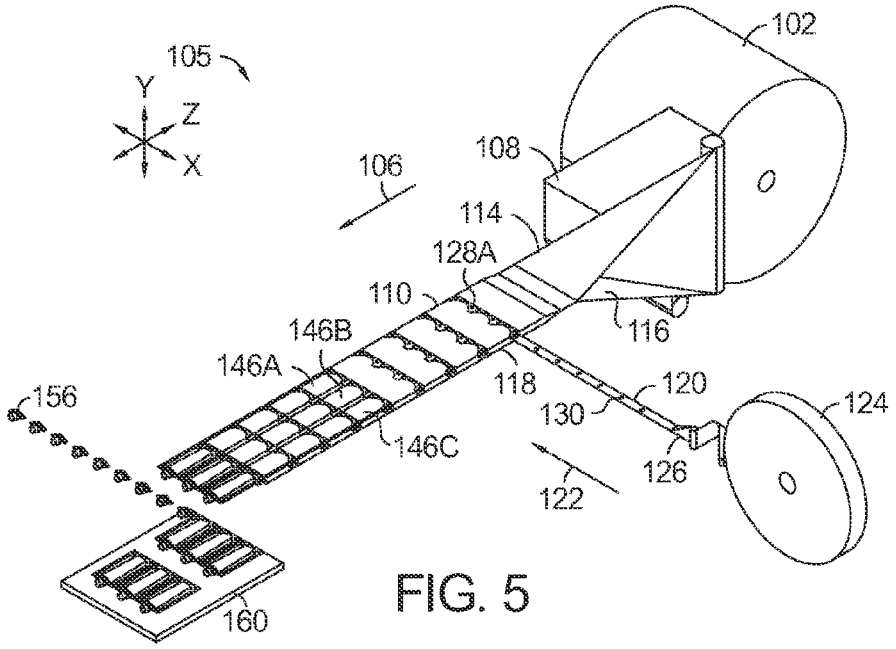
FIG. 5 is a perspective schematic view of yet another embodiment of a method for manufacturing a bottom gusseted pouch having a fitment in accordance with the present invention.
Figure 6A:
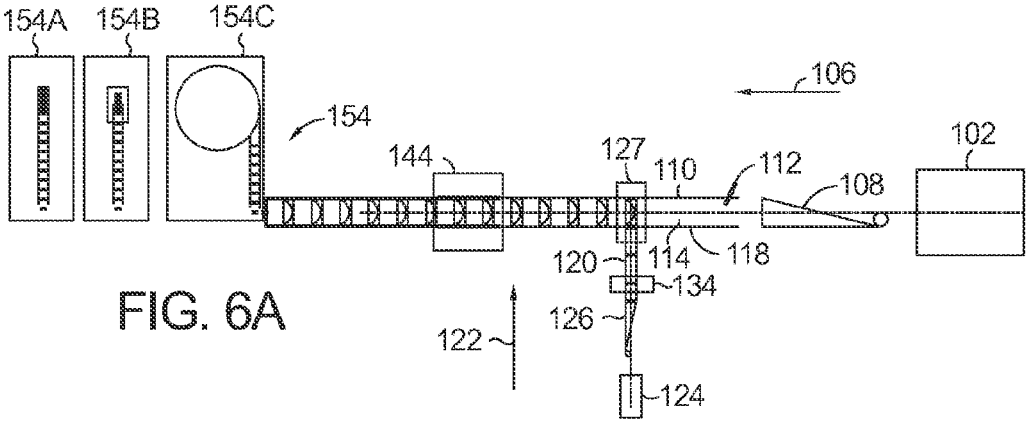
FIG. 6A is a top view schematic of the method shown in FIG. 5.
Figure 6B:
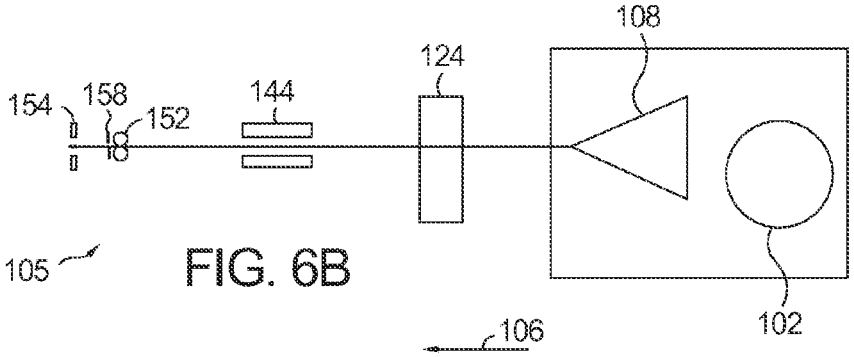
FIG. 6B is a side view schematic of the method shown in FIG. 5.

Referring to FIGS. 5, 6A and 6B, reference numeral 105 generally designates a method of manufacturing a bottom gusseted pouch including a fitment in accordance with another aspect of the present invention. Similar to method 100 described above, to initiate method 105, a single pouch webbing roll 102 is unwound in first flow direction 106 and folded within webbing folder 118 to create a folded pouch webbing. For example, pouch webbing roll 102 may be folded evenly along its longitudinal axis to form a seam along webbing edge 110. The seam is then sliced open via seam slitter 112 (FIG. 6A) to form front panel 114 and back panel 116, each having edges 110 and 118.

With front and back panels 114, 116 formed and positioned on top of one another, gusset webbing 120 is inserted between front and back panels 114, 116 in second flow direction 122 that is transverse to first flow direction 106 of pouch webbing 104. Gusset webbing 120 is unwound from gusset webbing roll 124 and may be folded evenly along is longitudinal axis by gusset folder 126. As previously mentioned, the folded gusset webbing allows for the expansion of the completed pouch upon filling, and also provides a wider base such that the completed pouch can freely stand upon its bottom gusseted end. After the desired length of gusset webbing 120 has been inserted, gusset webbing 120 is then cut from gusset roll 124. The inserted gusset webbing 120 is then sealed to the inner surface of each of front panel 114 and back panel 116 to form the bottom gusseted pouch at a gusset seal similar to gusset seal 128 as shown in FIG. 1, or as a scalloped bottom gusset seal 128A as shown in FIG. 5 to form laterally connected side-by-side oriented pouches similar to those described above with regard to FIG. 4. While described above as being cut before being sealed, it is within the scope of the invention that gusset webbing 120 may be sealed to front and back panels 114, 116 prior to being cut from gusset roll 124. Gusset webbing 120 may further have one or more gusset holes 130 defined therein by gusset punch 132 (see FIG. 6A) as was described above.

Once gusset webbing 120 has been inserted and sealed to front and back panels 114, 116, in-line sealer 144 (such as that shown in FIGS. 6A and 6B) is adapted to seal side edges 110, 118 to form a single pouch, or may further create one or more heat seals parallel to side edges 110, 118, wherein the internal heat seal coincides with the open ends of scalloped gusset webbing seal 128A. In this manner, as shown in FIG. 5, a plurality of laterally connected side-by-side oriented pouches (e.g., pouches 146A, 146B, 146C) may be manufactured as pouch webbing 104 advances in first flow direction 106 (i.e. the direction of unwinding pouch roll 102). While shown and described as producing laterally connected side-by-side pouches 146A, 146B, 146C connected serially in a top-to-bottom end configuration, it is to be understood by those skilled in the art that individual bottom gusseted pouches connected serially in a top-to-bottom end configuration may be formed according to this method analogously to those formed in method 100 described above.

Once the side edges 110, 118 of front and back panels 114, 116 are sealed to one another, and bottom gusset webbing 120 are sealed to front and back panels 114, 116, pouches 146A, 146B, 146C are advanced by one or more web feed rollers 152 until the open top ends of pouches 146A, 146B, 146C engage a fitment feed and seal device 154, wherein a fitment 156 is positioned between front and back panels 114, 116, and sealed to the open top end of each pouch to produce a completed bottom gusseted pouch with integral fitment. Fitment 156 may include, but is not limited to, a cylindrical spout that is configured to selectively receive a fitment cap, such as a screw top or spout, to allow contents contained within a completed pouch to be poured out of the completed pouch. Examples of suitable fitment feed and seal device 154 include, but are not limited to, a roll feed device 154A, a magazine feed device 154B or a bowl feed device 154C. Once fitment 156 has been inserted and sealed to the pouch, the completed pouch with fitment may be disconnected from the adjacently connected pouches by a pouch cutter 158. The completed pouches are then arranged for later use, such as by palletizing on a pallet 160.

In accordance with an aspect of the present invention, fitment feed and seal device 154 is adapted to provide monitoring and manipulation of each fitment 156 with respect to the fitment's 156 alignment with the open top end of pouches 146A, 146B, and/or 146C. In particular, fitment feed and seal device 154 is configured for controlling the position and orientation of fitment 156 (such as along any or all Cartesian axes: x, y, z) to ensure proper alignment of fitment 156 between front and back panels 114, 116 of the pouch and minimize, and preferably eliminate, any mis-alignments and subsequent mis-seals of fitment 156 with the top end of the respective pouch. Fitment 156 position and orientation is maintained through the servo-feed and indexing of the pouch forming machine (such as that one used in method 105) which allows for accurate positioning of pouch 146 (or pouches 146A, 146B, 146C) with respect to fitment feed and seal device 154. Proper positioning of pouch 146 (pouches 146A, 146B, 146C) also assists in releasing the completed pouches from the tension section of the machine through pouch cutter 158 while minimizing the risk of improperly slicing the sealed portion of the completed pouch or pouches.

Figure 7A:
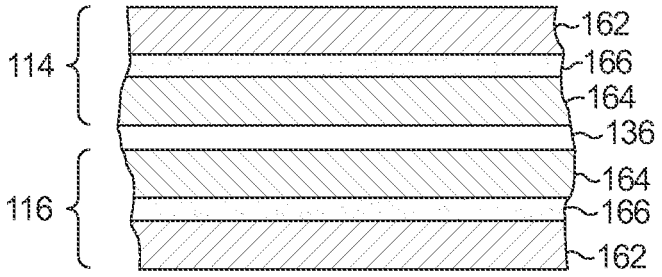
FIG. 7A is a cross sectional view one exemplary structured film webbing material that may be used in an embodiment of a method for manufacturing a bottom gusseted pouch in accordance with the present invention.
Figure 7B:
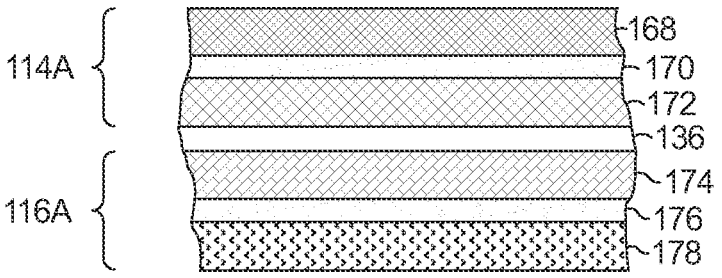
FIG. 7B is a cross sectional view of another exemplary webbing material that may be used in an embodiment of a method for manufacturing a bottom gusseted pouch in accordance with the present invention.

With regard to FIGS. 7A and 7B, one aspect of the present invention utilizes webbing materials comprised of supported films including at least a first film layer and a second film layer. That is, the webbing material, such as pouch webbing 104 and/or gusset webbing 120, may be comprised of a multilayer film, and more preferably of a multiplayer film wherein at least two of the individual film layers within the multilayer film have different heat indexes. In accordance with an aspect of the present invention, the film having the higher heat index forms the outer layer of the bottom gusseted pouch while the film having the lower heat index forms the inner layer of the bottom gusseted pouch (i.e. defines the interior compartment). In this manner, the magnitude of the heat applied to the pouch webbing when forming the heat seal is selected such that the magnitude is greater than the heat index of the inner layer yet below that of the outer layer. As a result, the inner layers of respective front panel, back panel or gusset webbing fuse together to form the requisite seal without distorting or otherwise damaging the outer layer of the pouch.

The use of supported films in the present method may be used to construct one or more of front panel 114, 114A, back panel 116,116A, and bottom gusset 120. For instance, as shown in FIG. 7A, when using a single sheet webbing 104 for front and back panels 114, 116 (such as that shown in FIGS. 1, 4 and 5) or for folded gusset webbing 120 (FIGS. 1, 3-5), folding of the sheet will result in the outer surface of the sheet being a first film layer 162 with the opposing surface becoming the inner surface of the sheet including a second film layer 164 defining an interior compartment 136 of the pouch. Further, a third film layer 166, such as a tie layer, may be positioned between first and second film layers 162, 164, and have the same heat index of one of the first or second film layers 162, 164, or have a heat index that is different than first and second film layers 160, 164. Alternatively, as shown in FIG. 7B, front panel 114A may be constructed of different materials (film layers 168, 170, 172) than back panel 114B (film layers 174, 176, 178) as desired or dictated by the proposed end use of the pouch using the two pouch roll 102A, 102B shown in the method 101 (FIG. 3).

The supported films may be constructed by any known or future developed manufacturing process, including but not limited to, lamination, extrusion, coextrusion or combinations thereof. While it has been shown and described herein to use three film layers to form the structured film that makes up the webbing, it should be understood that it is within the scope of the present invention to utilize webbing that includes two film layers and more than three film layers. Examples of such film layers include layers imparting desired performance characteristics to the completed pouches such as desired adhesive properties/strengths, moisture barrier/permeability, oxygen barrier/permeability, and the ability to print onto the layer. Materials which may comprise one or more layers within the multilayer film include polymeric/copolymeric films formed of materials, such as, but not limited to, nylon, polyethylene, polypropylene, polyester, polylactic acid, polyvinyl chloride, and any weights, modifications and/or orientations of such polymers; metal films such as aluminum; metal coatings such as aluminum oxide; and combinations thereof.

Figure 8:
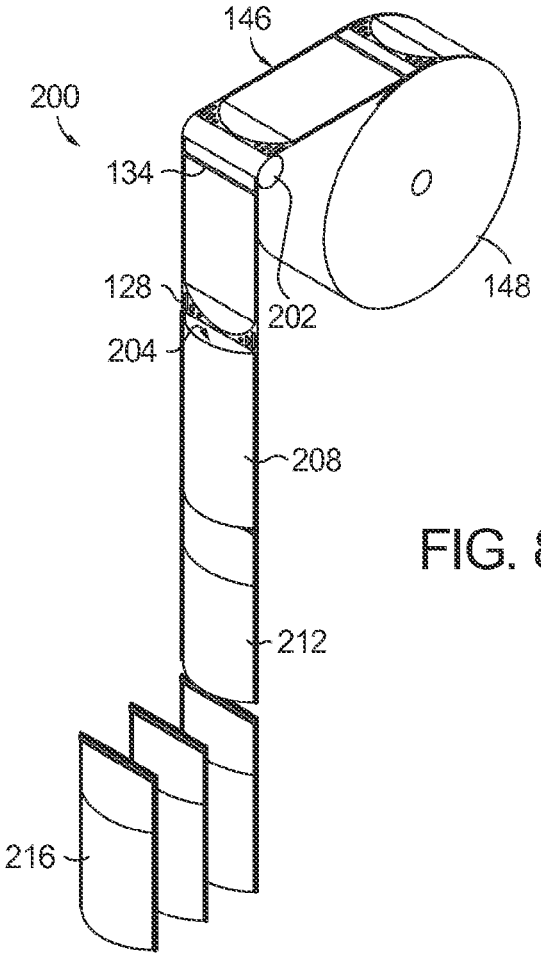
FIG. 8 is a perspective schematic view embodiment of a method for filling a bottom gusseted pouch including a resealable end in accordance with the present invention.
Figure 9:
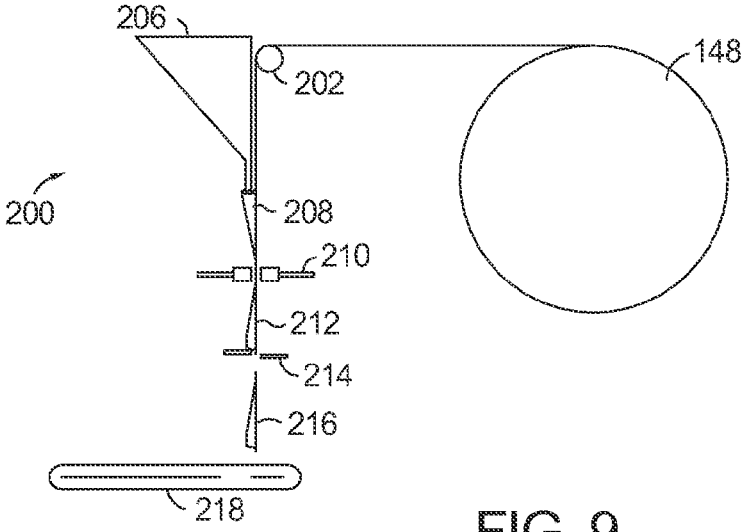
FIG. 9 is a side view of the method shown in FIG. 8.

Referring now to FIGS. 8 and 9, reference numeral 200 generally designates a method of filling a bottom gusseted pouch 146 in accordance with another aspect of the present invention. As can be seen in the drawings, a roll of bottom gusseted pouches, such as roll 148, produced using manufacturing method 100 described above, is unwound and draped over a roller 202 such that the bottom gusset seal 128 of a respective pouch 146 is positioned vertically below its respective top closure mechanism 134. The top closure mechanism 134 is then opened so as to define an opening 204 within pouch 146. A filling apparatus, such as hopper 206 then dispenses one or more items through opening 204 and into the interior compartment 136 to create a filled pouch 208. The items placed within interior compartment may be any type of consumer product, as well as food and beverage products. Filled pouch 208 then advances to a pouch sealer 210 where filled pouch 208 is sealed closed. In accordance with an embodiment of the invention, pouch sealer 210 may operate to re-secure top closure mechanism 134. In a further embodiment, pouch sealer 210 operates to create a heat seal above top closure mechanism 134, but below gusset seal 128 of the next succeeding filled pouch 208. The sealed pouch 212 is then cut from the pouch roll 148 by pouch cutter 214. It should be understood that the method also may include the step of cutting pouch 212 from pouch 208 prior to filling pouch 212. The cut and filled pouch 216 may then be directed to a stacking/packaging/palletizing location by way of conveyor 218.

Figure 10:
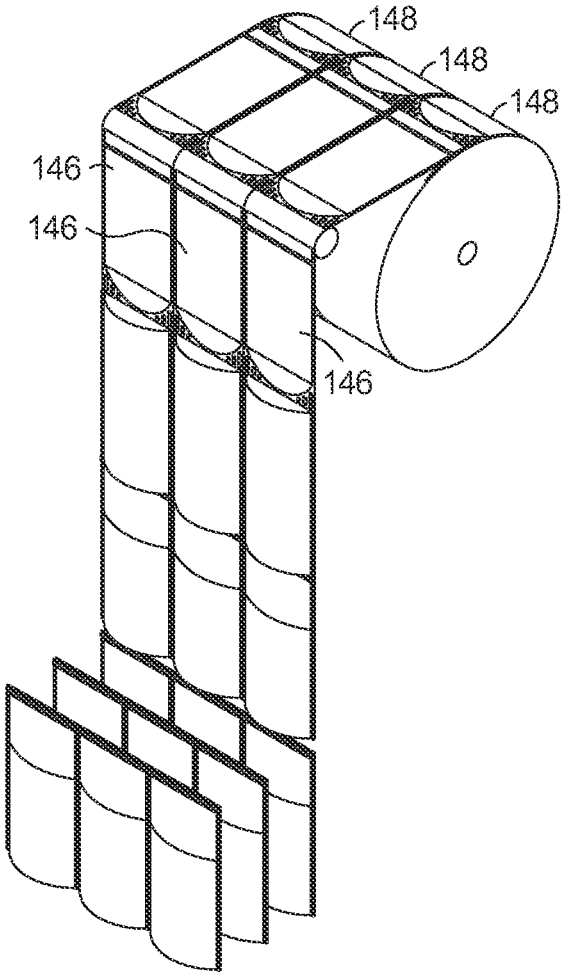
FIG. 10 is a perspective schematic view embodiment of a method for filling a plurality of bottom gusseted pouches in accordance with the present invention.

As shown in FIG. 10, filling method 200 may be scalable such that pouch roll 150 or a plurality of pouch rolls 148 may be arranged in side-by-side orientation such that each pouch 146 on respective rolls may be unwound, filled, sealed, and cut in parallel fashion to increase the filling efficiency.

Figure 12:
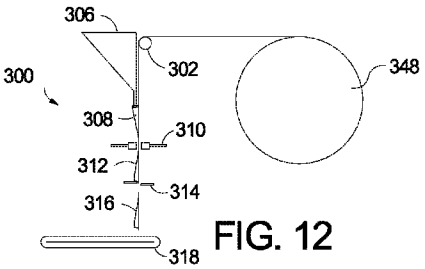
FIG. 12 is a side view of the method shown in FIG. 11.
Figure 11:
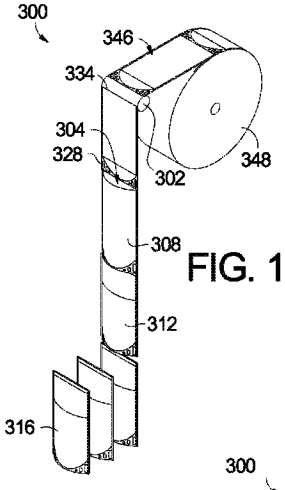
FIG. 11 is a perspective schematic view embodiment of a method for filling a bottom gusseted pouch that does not include a resealable end in accordance with the present invention.

Referring now to FIGS. 11 and 12, reference numeral 300 generally designates a method of filling a bottom gusseted pouch 346 in accordance with yet another aspect of the present invention. Method 300 is similar to method 200 as previously described except that pouch 346 does not include top closure mechanism 134. As can be seen in the drawings, a roll of bottom gusseted pouches, such as roll 348, produced using manufacturing method 100 (excluding closure mechanism 134) described above, is unwound and draped over a roller 302 such that the bottom gusset seal 328 of a respective pouch 346 is positioned vertically below its respective top end 334. The top end 334 is opened so as to define an opening 304 within pouch 346. A filling apparatus, such as hopper 306 dispenses one or more items through opening 304 and into an interior compartment to create a filled pouch 308. The items placed within interior compartment may be any type of consumer product, as well as food and beverage products. Filled pouch 308 advances to a pouch sealer 310 where filled pouch 308 may be sealed closed. In accordance with an embodiment of the invention, pouch sealer 310 may operate to create a heat seal at the top end of pouch 308, but below gusset seal 328 of the next succeeding filled pouch 308. The sealed pouch 312 may then be cut from the pouch roll 348 by pouch cutter 314. It should be understood that the method also may include the step of cutting pouch 312 from pouch 308 prior to filling pouch 312. The cut and filled pouch 316 may then be directed to a stacking/packaging/palletizing location by way of conveyor 318.

Figure 13:
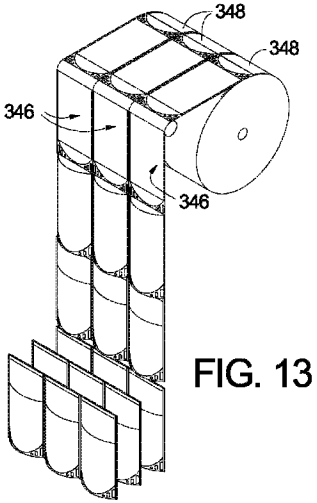
FIG. 13 is a perspective schematic view embodiment of a method for filling a plurality of bottom gusseted pouches that do not include a resealable end in accordance with the present invention.

As shown in FIG. 13, filling method 300 may be scalable such that a plurality of pouch rolls 348 may be arranged in side-by-side orientation such that each pouch 346 on respective rolls may be unwound, filled, sealed, and cut in parallel fashion to increase the filling efficiency. Alternatively, a single pouch roll, similar to pouch roll 150, may be used in method 300 to provide the efficiency provided with rolls 348.

Figure 15:
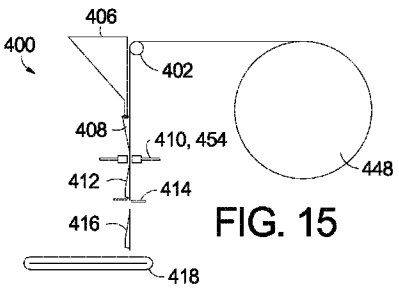
FIG. 15 is a side view of the method shown in FIG. 15.
Figure 14:
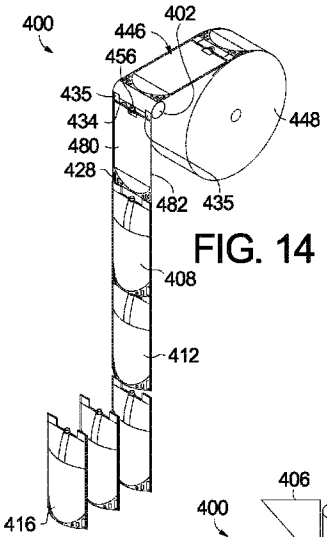
FIG. 14 is a perspective schematic view embodiment of a method for filling a bottom gusseted pouch including a fitment disposed in a top end thereof in accordance with the present invention.

Referring now to FIGS. 14 and 15, reference numeral 400 generally designates a method of filling a bottom gusseted pouch 446 in accordance with yet another aspect of the present invention. Method 400 is similar to methods 200, 300 as previously described except that pouch 446 includes a fitment 456 disposed between front and back panels 480, 482 located at a top end 434 of pouch 446. Top end 434 includes one or more extension pieces 435 that operate to connect adjacent pouches 446 to one another in a top-to-bottom orientation on pouch roll 448. As can be seen in the drawings, the roll of bottom gusseted pouches, such as roll 448, produced using manufacturing method 105 described above, is unwound and draped over a roller 402 such that the bottom gusset seal 428 of a respective pouch 446 is positioned vertically below its respective top end 434. A filling apparatus, such as hopper 406 dispenses one or more items through fitment 456 and into an interior compartment to create a filled pouch 408. The items placed within interior compartment may be any type of consumer product, as well as food and beverage products. Filled pouch 408 advances to a seal device 454 where filled pouch 408 may be sealed closed using a fitment cap. In accordance with an embodiment of the invention, a pouch sealer 410 may optionally operate to create a heat seal at top end 434 of pouch 408, but below gusset seal 428 of the next succeeding filled pouch 408. The pouch 412 with the closed fitment 456 may be cut from the pouch roll 448 by pouch cutter 414 between extension pieces 435 and bottom gusset seal 428 of the next adjacent pouch 446. It should be understood that the method 400 also may include the step of cutting pouch 412 from pouch 408 prior to filling pouch 412. The cut and filled pouch 416 may then be directed to a stacking/packaging/palletizing location by way of conveyor 418.

Figure 16:
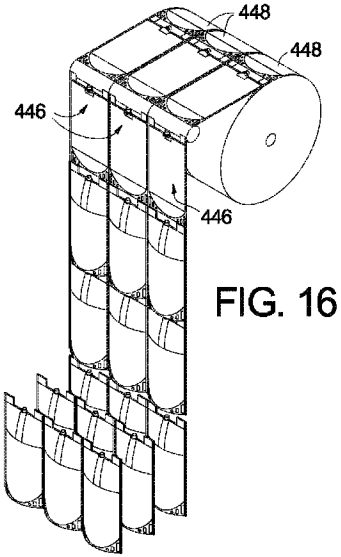
FIG. 16 is a perspective schematic view embodiment of a method for filling a plurality of bottom gusseted pouches including a fitment disposed in a top end in accordance with the present invention.

As shown in FIG. 16, filling method 400 may be scalable such that a plurality of pouch rolls 448 may be arranged in side-by-side orientation such that each pouch 446 on respective rolls may be unwound, filled, closed, and cut in parallel fashion to increase the filling efficiency. Alternatively, a single pouch roll, similar to pouch roll 150, may be used in method 400 to provide the efficiency provided with rolls 448.

Figure 18:
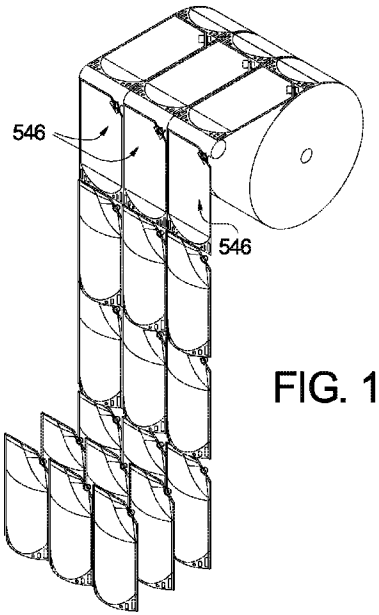
FIG. 18 is a perspective schematic view embodiment of a method for filling a plurality of bottom gusseted pouches including a corner fitment in accordance with the present invention.
Figure 17:
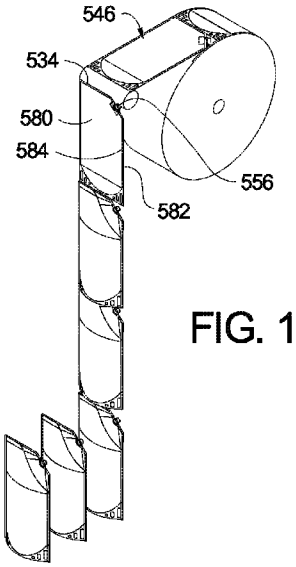
FIG. 17 is a perspective schematic view embodiment of a method for filling a bottom gusseted pouch including a corner fitment in accordance with the present invention.

In another aspect of the present invention, the previously described method 400 of filling may also be used to fill a pouch 546 including a corner fitment 556, as best seen in FIGS. 17 and 18. However, instead of fitment 456 being disposed between front and back panels 480, 482 located at a top end 434 of pouch 446 (FIG. 14), corner fitment 556 is disposed between front and back panels 580, 582 and positioned at an angle relative to a top end 534 and an adjacent edge 584.

Figure 20:
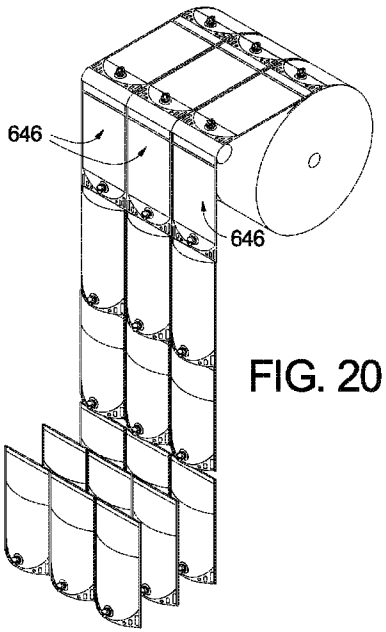
FIG. 20 is a perspective schematic view embodiment of a method for filling a plurality of bottom gusseted pouches including a face fitment in accordance with the present invention.
Figure 19:
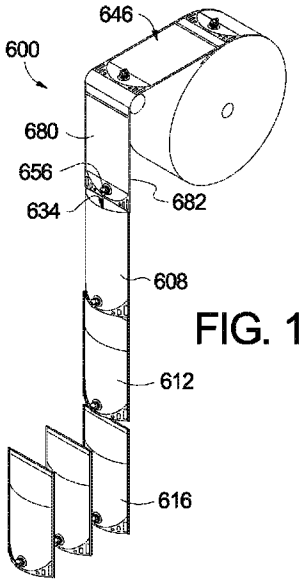
FIG. 19 is a perspective schematic view embodiment of a method for filling a bottom gusseted pouch including a face fitment in accordance with the present invention.

In yet another aspect, as best seen in FIGS. 19 and 20, the present invention is also directed to a method 600 of filling a pouch 646 including a face fitment 656 disposed in at least one of front and back panels 680, 682. Method 600 may include aspects of both methods 300 and 400. In particular, and similar to method 300, pouch 646 may include an open top end 634 that allows the interior compartment of pouch 646 to be filled therethrough with at least one item, sealed to form a sealed pouch 612, and then cut to form pouch 616. It should be understood that method 600 also may include the step of cutting pouch 612 from pouch 608 prior to filling pouch 612. Method 600 may alternatively, or additionally, be filled with at least one item through face fitment 656 in a similar manner described with respect to method 400, and then sealed by inserting a cap fitment.

Although the present invention has been described in considerable detail with reference to certain aspects thereof, other versions are possible. Therefore, the spirit and scope of the appended claims should not be limited to the description of the aspects contained herein.

All features disclosed in the specification, including the claims, abstract, and drawings, and all the steps in any method or process disclosed, may be combined in any combination, except combinations where at least some of such features and/or steps are mutually exclusive. Each feature disclosed in the specification, including the claims, abstract, and drawings, can be replaced by alternative features serving the same, equivalent or similar purpose, unless expressly stated otherwise. Thus, unless expressly stated otherwise, each feature disclosed is one example only of a generic series of equivalent or similar features.

What is claimed is:

1. A method of filling a plurality of bottom gusseted pouches disposed on a roll, the method comprising:

a) providing each of the plurality of bottom gusseted pouches with front and back panels, a bottom gusseted end, a top end, and sealed first and second side edges, wherein the plurality of bottom gusseted pouches are serially connected to one another in a top-to-bottom end orientation on the roll, wherein the top end of a respective bottom gusseted pouch on the roll is connected to the bottom gusseted end of an adjacent one of the plurality of bottom gusseted pouches on the roll;

b) unwinding the respective bottom gusseted pouch from the roll of bottom gusseted pouches;

c) providing access to an interior compartment defined by the front and back panels and the bottom gusseted end of the respective bottom gusseted pouch;

d) filling the interior compartment with at least one item to produce a filled pouch;

e) cutting the respective bottom gusseted pouch from the roll by cutting between the top end of the respective bottom gusseted pouch and the bottom gusseted end of the adjacent one of the plurality bottom gusseted pouches connected to the respective bottom gusseted pouch; and f) repeating steps b)-e) with respect to the adjacent one of the plurality bottom gusseted pouches.

2. The method in accordance with claim 1, wherein the step of providing access to the interior compartment includes opening the top end of the respective bottom gusseted pouch.

3. The method in accordance with claim 1, wherein the plurality of bottom gusseted pouches are further connected in a side-to-side orientation on the roll such that the first side edge of the respective bottom gusseted pouch is connected to the second side edge of a side positioned bottom gusseted pouch on the roll.

4. The method in accordance with claim 3, wherein the respective bottom gusseted pouch and the side positioned gusseted pouch are unwound, opened, filled, and cut in parallel in accordance with steps b), c), d), and e).

5. The method in accordance with claim 1, wherein the respective bottom gusseted pouch is unwound from the roll of bottom gusseted pouches so that the bottom gusseted end of the respective bottom gusseted pouch is located vertically below the top end of the respective bottom gusseted pouch.

6. The method in accordance with claim 1, further comprising the step of sealing the top end to enclose the at least one item within the interior compartment.

7. The method in accordance with claim 1, further comprising the step of forming a heat seal between the top end of the filled pouch and the bottom gusseted end of the adjacent bottom gusseted pouch prior to step e).

8. The method in accordance with claim 1, wherein the top end is a top resealable end, wherein the step of providing access to the interior compartment includes opening the top resealable end of the respective bottom gusseted pouch.

9. The method in accordance with claim 8, further comprising the step of closing the top resealable end to enclose the at least one item within the interior compartment.

10. The method in accordance with claim 8, wherein the top resealable end includes a closure mechanism.

11. The method in accordance with claim 8, further comprising the step of forming a heat seal between the top resealable end of the filled pouch and the bottom gusseted end of the adjacent bottom gusseted pouch prior to step e).

12. The method in accordance with claim 8, wherein the plurality of bottom gusseted pouches are further connected in a side-to-side orientation on the roll such that the first side edge of the respective bottom gusseted pouch is connected to the second side edge of a side positioned bottom gusseted pouch on the roll.

13. The method in accordance with claim 12, wherein the respective bottom gusseted pouch and the side positioned gusseted pouch are unwound, opened, filled, and cut in parallel in accordance with steps b), c), d), and e).

14. The method in accordance with claim 8, wherein the respective bottom gusseted pouch is unwound from the roll of bottom gusseted pouches so that the bottom gusseted end of the respective bottom gusseted pouch is located vertically below the top resealable end of the respective bottom gusseted pouch.

15. The method in accordance with claim 1, wherein the step of providing access to the interior compartment includes providing a fitment disposed in at least one of: i) the front panel; ii) the back panel; iii) between the front and back panels positioned at the top end; or iv) between the front and back panels and positioned at an angle relative to the top end.

16. The method in accordance with claim 15, further comprising the step of sealing the fitment to enclose the at least one item within the interior compartment.

17. The method in accordance with claim 16, wherein a fitment cap is used to seal the fitment.

18. The method in accordance with claim 15, wherein the step of cutting the respective bottom gusseted pouch from the roll occurs prior to the step of filling the interior compartment with at least one item to produce the filled pouch.

19. The method in accordance with claim 15, wherein the plurality of bottom gusseted pouches are further connected in a side-to-side orientation on the roll such that the first side edge of the respective bottom gusseted pouch is connected to the second side edge of a side positioned bottom gusseted pouch on the roll.

20. The method in accordance with claim 19, wherein the respective bottom gusseted pouch and the side positioned gusseted pouch are unwound, opened, filled, and cut in parallel in accordance with steps b), c), d), and e).

21. The method in accordance with claim 15, wherein the respective bottom gusseted pouch is unwound from the roll of bottom gusseted pouches so that the bottom gusseted end of the respective bottom gusseted pouch is located vertically below the top resealable end of the respective bottom gusseted pouch.

22. The method in accordance with claim 15, wherein at least one of the front panel, the back panel and the bottom gusset is a supported film including a first film layer and a second film layer.

23. The method in accordance with claim 22, wherein the first film layer has a lower heat index than the second film layer.

24. The method in accordance with claim 23, wherein the second film layer is an outer surface of at least one of the front panel or the back panel.

25. The method in accordance with claim 22, wherein at least one of the first film layer and the second film layer is formed of nylon, polyethylene, polypropylene, polyester, a metal foil, or combinations thereof.

26. The method in accordance with claim 25, wherein two or more of the front panel, the back panel, and the gusset webbing are formed of different materials.

27. The method in accordance with claim 22, wherein the supported film is fabricated by lamination, extrusion, coextrusion, or combinations thereof.

* * * * *